United States Patent [19]

Hollonbeck et al.

[11] Patent Number: 4,565,409

[45] Date of Patent: Jan. 21, 1986

[54] BODY SUPPORT APPARATUS

[76] Inventors: Gary G. Hollonbeck, 181 E. Rte. 38; Hugh E. Cooper, 1253 Tilton Park Dr., both of Rochelle, Ill. 61068

[21] Appl. No.: 555,385

[22] Filed: Nov. 28, 1983

[51] Int. Cl.[4] ..... A47C 7/54

[52] U.S. Cl. ..... 297/411; 297/414; 297/418; 297/463

[58] Field of Search ..... 248/635; 297/411, 463, 297/414, 418; 135/65, 68, 69, 84, 73, 71; 128/394, 78, 134, 520, 544; 403/108, 329, 220–225

[56] References Cited

U.S. PATENT DOCUMENTS

| | | | |
|---|---|---|---|
| 1,722,205 | 7/1929 | Freund | 128/78 |
| 1,930,310 | 10/1933 | Geyer | 248/635 |
| 2,386,248 | 10/1945 | Marzetti | 248/635 |
| 2,571,281 | 10/1951 | Neher | 403/220 X |
| 2,667,913 | 2/1954 | Dustin | 297/463 |
| 2,667,917 | 2/1954 | Dustin | 135/73 X |
| 2,711,183 | 6/1955 | Lofstrand, Jr. | 135/69 |
| 3,004,794 | 10/1961 | Yerkovich | 297/463 X |
| 3,531,158 | 9/1970 | Allan | 297/463 X |
| 3,947,140 | 3/1976 | Thomas | 403/108 |

*Primary Examiner*—James T. McCall

*Attorney, Agent, or Firm*—Emrich & Dithmar

[57] ABSTRACT

A body support apparatus including a pair of supporting implement for supporting the body weight of the user when in a seated position to relieve pressure on the spinal column, each implement including a base member, a height adjustable upright and an armrest carried by the upright, the upright being resiliently secured to the base, permitting universal movement of the upright, and the arm-rest, relative to the base.

5 Claims, 5 Drawing Figures

BODY SUPPORT APPARATUS

BACKGROUND OF THE INVENTION

This invention relates to body support apparatus, and more particularly, to spinal column supporting implements which in use are located in erect positions so as to relieve the pressure of the body weight of the user on the user's spinal column and related tissue in the immediate area surrounding the spinal column.

Many people suffer from back problem pain, whether acute, chronic or fatiguing. Back pain usually results from compression of the spinal column and the related tissue in the immediate area surrounding the spinal column. The compression is the result of the normal function of the spinal column in supporting body weight. When the compression becomes abnormal or excessive, severe back pain results.

Back pain tends to become most pronounced when a person is required to remain in a sitting position for a long period, and most particularly when seated in an automotive seat, an office chair or other seat because such seats generally are not designed to provide proper support for the body. When a person remains seated for a long period of time, there is a tendency for the upper body to slump due to fatigue, or poor posture, aggravating the problem. Further, some persons, because of sickness or weakness from other causes, find it difficult or painful to support the upper portion of their body in an erect position for extended periods of time.

Various devices have been proposed by the prior art to mechanically support a portion of the body weight which is normally physically supported by the spinal column when the body is in a sitting position. Generally, such support devices take the form of a pair of vertically extending support members, each of which carries an armrest at its upper end, with the lower ends being commonly connected to a support frame or individually attached to the chair occupied by the user. In use, the support members are placed on each side of the user and individually adjusted so that the armrests fit snugly beneath the armpits of the user. By using such support devices, the weight of the body is not borne totally by the spinal column, but largely borne by the underarms, and the amount of the weight borne by the support can be adjusted according to the desires of the user.

The best support is provided when the support members extend vertically. However, known body support devices have either had their bottom ends attached to a support frame or directly attached to the chair, and such arrangements require that the support assembly be designed or modified for the person who will be using it. Moreover, although the bottom ends of the support members may be pivotally attached to the frame or to the chair, allowing the user to move, as when the person leans forward or turns slightly sideways, when the person returns to the initial position, the support members may not. As a result, the person will again have to shift positions to find the most comfortable position. A further shortcoming of known body support arrangements is that the armrest is designed to engage the armpits resulting in considerable pressure at the middle of the armpits and an attendant tendency of numbness occurring in the arms. The foregoing problems tend to counteract the advantages of the body support device because while alleviating back pain on the one hand, these prior art devices may cause other problems such as discomfort in seating.

SUMMARY OF THE INVENTION

It is an object of the present invention to provide an improved body support apparatus.

It is an other object of the invention to provide an improved body support apparatus which does not require installation, such as attachment to a chair, for use, and which may be used readily and easily by any person.

It is yet another object of the present invention to provide a body support apparatus including an improved armrest portion which more easily distributes the body weight being supported along the inner arm.

Another object of the invention is to provide a body support apparatus including a pair of supporting implements each having an armrest attached to a vertically extending support member which is connected to a base wherein the extension member and armrest assembly is rotatable as well as fore and aft and sideways, providing maximum flexibility in motion for the support device.

These and other objects are achieved by the present invention which provides a body support apparatus including a pair of supporting implements which in use are arranged vertically on opposite sides of a person to support the body weight of the person when in a seated position and thereby to relieve pressure on the spinal column of the person, each of said implements comprising a base member having a planar underside defining a wide area of contact between the base member and the seat on which the person sits in close relation to the side of said person, an upright assembly of adjustable height including an inner member and an outer member disposed in telescopic coaxial relation, an armrest fixed to the upper end of one of said members in crosswise relation to the axis of said upright assembly, and mounting means secured to said base and fixed to the lower end of the other one of said members and having a resilient connecting member permitting universal movement of said upright assembly relative to said base member from its generally vertical orientation when the user moves from a generally erect position and causing said upright assembly to return automatically to its generally vertical orientation when the user returns to a generally erect position.

DESCRIPTION OF PREFERRED EMBODIMENTS

Figure 1:
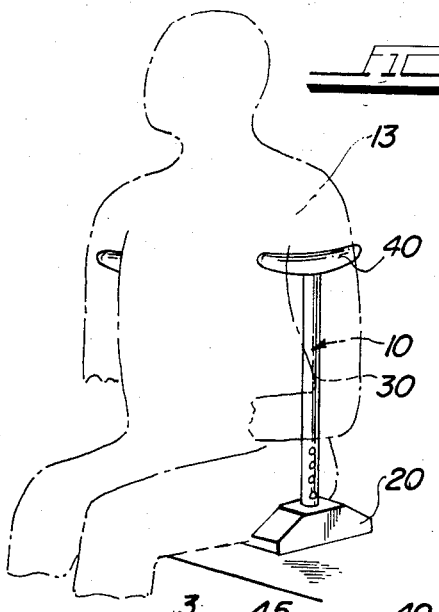
FIG. 1 illustrates how the body support apparatus of the present invention is used by an individual.
Figure 2:
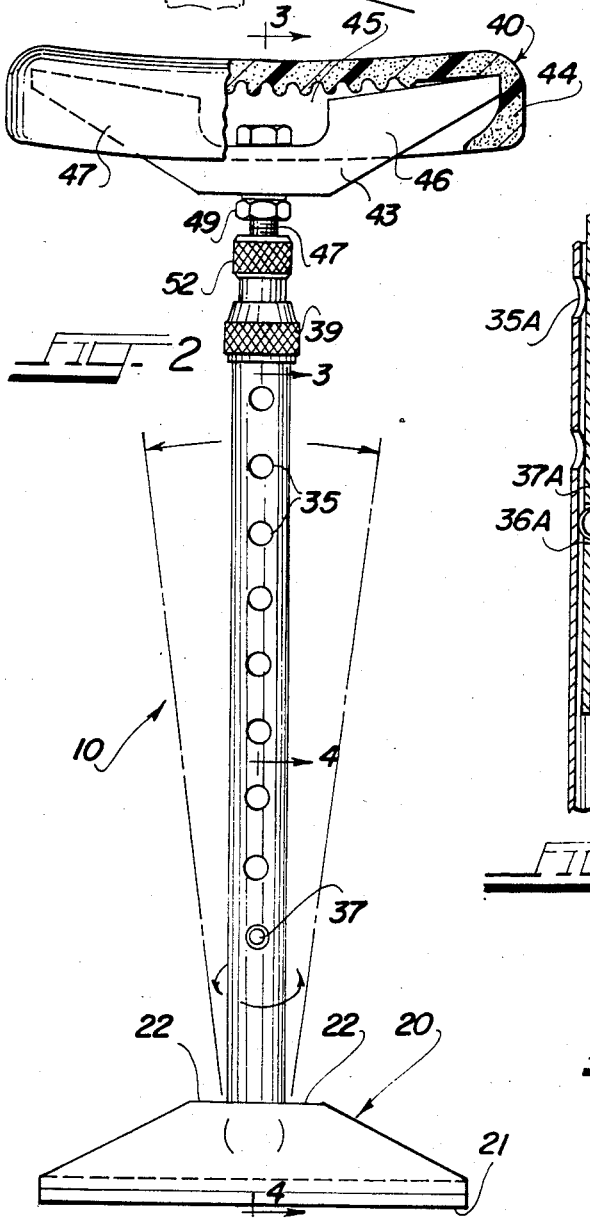
FIG. 2 is a side elevation view of one of the body support implements which comprise the body support apparatus provided by the present invention.
Figure 4:
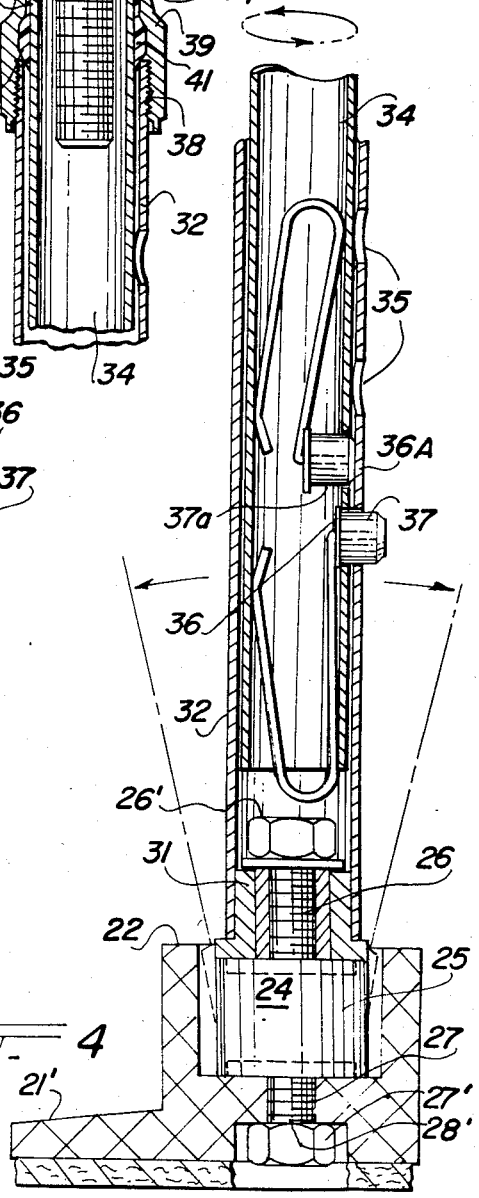
FIG. 4 is a sectional view taken along lines 4—4 of FIG. 2.

Referring to FIG. 1, the body support apparatus of the present invention includes a pair of supporting implements, each device being arranged vertically on an opposite side of the person to support the body weight of the user when in a seated position to relieve pressure on the spinal column. Each implement, such as implement 10 shown in FIG. 1, includes a base 20, an adjustable upright assembly 30, including having one end attached to the base 20 and carrying an armrest assembly 40 at its other end. As shown in FIG. 2, the base 20, when viewed from its side, has a trapezoidal configuration which defines a generally broad bottom edge 21 which provides maximum contact between the base and the seat surface to maintain the base firm and stable when in use. The base tapers to a smaller top portion 22 which is countersunk as illustrated in FIG. 4 defining a compartment in which is located a resilient connector 24 which attaches the upright support assembly 30 to the base 20. The resilient connector 24 comprises a generally cylindrical rubber core 25 with studs or mounting bolts 26 and 27 embedded therein on each side and vulcanized thereto. Thus, the studs 26 and 27 are coupled together and wedged into vertical alignment by the rubber core but stud 26, for example, can be moved off vertical relative to stud 27, and will return to vertical alignment upon its release. Mounting bolt 27 extends through an aperture 28 in the bottom of the housing 20 and a nut **27*a* is threaded onto the mounting bolt securing the resilient connector member 24 at its bottom end to the base 20**.

The mounting bolt 26 passes through a collar 31, which is press fitted into tube 32 and is secured thereto by way of a nut **26*a*. The outer diameter of the rubber core 25 corresponds generally to although slightly larger than the outer diameter of tube 32, and the studs 26 and 27 extend coaxially with the upright assembly 30. The attachment of the outer tube 32 of the back support to the base by means of the rubber core affords maximum flexibility providing universal motion for the upright assembly 30 and the armrest 40 carried thereby. That is, the armrest assembly and its supporting upright assembly 30 are rotatable about the vertical axis represented by the circular arrow shown in FIG. 4, as well as being movable fore and aft and sideways as shown in FIGS. 2 and 4** by the arrows.

As illustrated in FIG. 4, the base 20 has a flange 21 adapted to be received under the buttock of the person using the implement to obtain close-in positioning of the back support implement in use.

Figure 5:
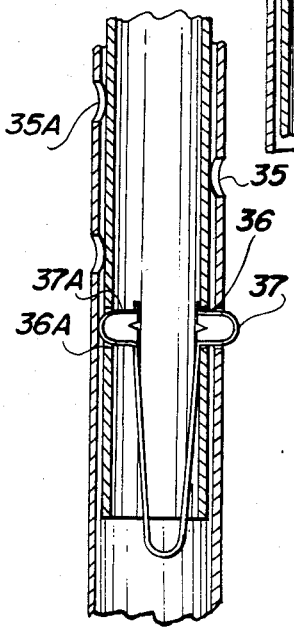
FIG. 5 is a partial view in section of the upright members for the body support implement illustrating an alternative height adjustment arrangement.

The upright assembly 30 includes an inner tube or sleeve 34, and an outer tube or sleeve 32, arranged in telescopic coaxial relation. A plurality of apertures 35 are provided in the outer tube 34 (FIG. 2) which are engageable by one or the other of two spring button assemblies 37 and 37A (FIG. 4), which are located within the inner tube 34, and extends through hole 35 therein. As shown in FIG. 4, the spring button assemblies 37 and 37A are located to define a half-space height adjustment (e.g. 0.5 inches) in that the two single spring button arrangements 37 and 37A provide half-space adjustments by depressing the spring loaded button through the outer tube hole 35 and moving the inner tube 34 one-half space (0.5 inch) to engage the next spring loaded button in the next outer tube hole. In this arrangement, a single set of holes is provided in the outer tube 32, and a pair of holes 36 and **36*a* are provided in tube 34, the spring buttons 37 and 37A are located to define the half-space adjustment. FIG. 5 illustrates an alternative half-space type adjustment in which the two single spring button members are carried by a single spring and two sets of holes 35 and 35A are provided on the outer tube, the holes being located at half-space positions. Here, the single spring with opposing buttons has the half-space adjustment principle in conjunction with the opposing lines of holes offset half the distance of the spacing on the outer tube 32**. Depressing the button through the hole of the outer tube and moving the inner tube one-half space completes the half-space adjustment.

Figure 3:
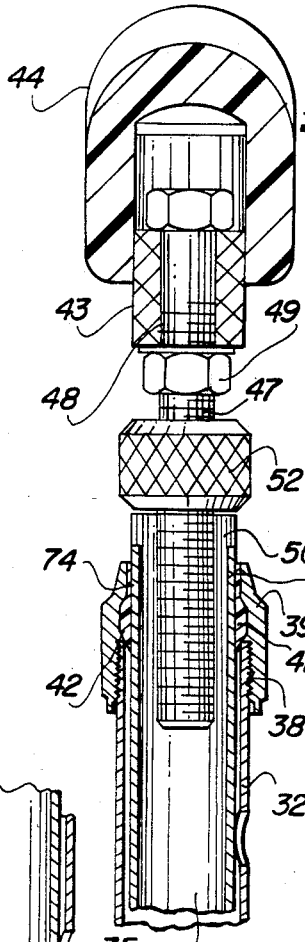
FIG. 3 is a sectional view taken along lines 3—3 of FIG. 2.

Referring now to FIGS. 2 and 3, the upper end of the outer tube 32 is threaded externally at 38 to receive an internally threaded knurled lock nut 39. A spacer 41 is located around the inner tube 34 and is compressed within a compartment 42 defined by the lock nut. When the lock nut 39 is tightened, it defines a compression fit to retain the inner and outer tubes 34 and 32 in place.

Referring to FIG. 2, the armrest assembly 40 includes a generally box-shaped support 43 covered by a pad 44. The member 43 has a central notch 45, defining a recessed area on the top of the member 43. A pair of outer extensions 46 and 46' which extend outwardly from the center portion of the member 43 and at a slight taper upwardly from the notch to the outer edge. The recessed area defined by the notch 45, providing an area of maximum cushioning in the proximity of the middle of the arm pit, when the implement is in place, providing relief from pressure at the middle of the armpit in use of the device. The outer extensions 46 and 46' of the armrest absorb the major portion of the pressure on the back device, increasing the surface area over which the pressure is distributed.

A threaded adjustment shaft 47 extends through an aperture 48 in member 43 and is held in place by means of a nut 49. Referring to FIG. 3, the shank of the adjustment shaft is received in a threaded guide 50 press fitted into the upper end of the inner tube 34. A knurled lock nut 52 retains the threaded shank at the position selected by the user.

The back support devices are used in pairs as illustrated in FIG. 1, with one device being placed under each arm of the user. The flange on the base (FIG. 4) is positioned under the buttock of the user on each side and the height of the upright support member is adjusted so that the proper amount of weight is being borne by the support member that is arranged vertically (at right angles to base 20), and the user is comfortable. The flange on the base permits each support device to be located as close as possible to the side of the person and the nonskid surface on the bottom of the base provides maximum contact on the seat surface to maintain the base firm and stable when in use. It is not necessary to use fasteners to establish stabilization such as by interconnecting the two base members.

The two single spring button arrangements are used to provide coarse adjustment of the height of the upright members. The user depresses the spring button 37 and slides the inner tube member 34 in or out of the outer tube member 32 as much as necessary to locate the armrest 40 beneath his armpit. Fine adjustment is provided by loosening the lock nut 52 and rotating the armrest assembly clockwise or counterclockwise to move the adjustment shaft respectively into or out of the upright members. When the proper or a comfortable height has been found, the lock nut 52 is tightened down. When lock nuts 52 and 39 are tightened, the whole device is rotatable about the resilient connector. This permits pivoting of the armrest by the user during positioning of the implement. Likewise, due to the lack of a metallic connection between the mounting bolts which connect the upright members 30 to the base 20, the upright members 30 and armrest 40 can be moved in any direction, fore, aft, or side to side, giving the user virtually total movement unobstructed. More importantly, when the user moves back to his initial position, the upright and armrest 40 will also return to this position by virtue of the resilience of the connector 24.

Therefore, the user is free to stretch out and disengage himself from the device with assurance that the device will substantially return to the adjusted position.

We claim:

1. Body support apparatus including a pair of supporting implements which in use are arranged vertically on opposite sides of a person to support the body weight of the person when in a seated position and thereby to relieve pressure on the spinal column of the person, each of said implements comprising a base member having a planar underside defining a wide area of contact between the base member and the seat on which the person sits in close relation to the side of said person;

an upright assembly of adjustable height including an inner member and an outer member disposed in telescopic coaxial relation, an armrest assembly fixed to the upper end of one of said telescoping members in crosswise relation to the axis of said upright assembly, with said armrest assembly including an elongated box-like member having a center portion adapted for attachment to one of said telescoping members and which in use is located beneath the arm pit of the user, and first and second extensions extending outwardly from said center portion and which in use are located beneath the front and rear portions of the arm of the user, and padding means carried on at least the upper portion of said block-like member, the upper surface of said center portion being recessed over substantially the entire extent thereof to define an area of maximum cushioning in the proximity of the middle of the arm pit and the extension absorbing the major portion of the force of the body weight applied to the implement in use; and mounting means secured to said base and fixed to the lower end of the other one of said telescoping members, said mounting means comprised of a cylindrical-shaped resilient connecting member having upper and lower mounting members attached thereto in substantially vertical alignment with respect to the centerline of said connecting member, with said lower mounting member securing said mounting means to said base member and said upper mounting member securing said mounting means to said lower end of the other one of said telescoping members, with said resilient connecting member permitting universal movement of said upright assembly relative to said base member from its generally vertical orientation when the user moves from a generally erect position and causing said upright assembly to return automatically to its generally vertical orientation when the user returns to a generally erect position.

2. Body support apparatus according to claim 1 wherein said resilient member defines a generally vertical axis and said upper and lower mounting members include upper and lower studs, respectively, embedded in said resilient member and aligned generally axially, with said lower stud to said base member and means for attaching said upper stud to said other telescoping member.

3. Body support apparatus according to claim 1 wherein said base member has a flange portion adapted to be positioned beneath the buttock of the user to locate the upright assembly and the armrest assembly carried thereby close to the side of the user.

4. Body support apparatus according to claim 1 wherein said telescoping members are in the form of elongated hollow tubes, the outer tube having a series of aligned holes along at least one side thereof, and the inner tube having at least one hole, and said upright assembly including a spring loaded pin located within said inner tube and adapted to pass through the hole in said inner and one of holes in said outer tube which are aligned with the hole in the inner tube to locate the armrest assembly at a desired height relative to the case.

5. Body support apparatus including a pair of supporting implements which in use are arranged vertically on opposite sides of a person to support the body weight of the person when in a seated position and thereby to relieve pressure on the spinal column of the person, each of said implements comprising a base member having a planar underside defining a wide area of contact between the base member and the seat on which the person sits in close relation to the side of said person;

an upright assembly of adjustable height including an inner sleeve member and an outer sleeve member disposed in telescopic coaxial relation, mounting means secured to said base and fixed to the lower end of one of said sleeve members for attaching said upright assembly to said base, with said mounting means adapted to maintain the implements in the vertical orientation, and an arm rest fixed to the upper end of the other end of said sleeve members in crosswise relation to the axis of said upright assembly and including an elongate box-like member having a center portion adapted for attachment to said other sleeve member and which in use is located beneath the arm pit of the user, and first and second extensions extending outwardly from said center portion and which in use are located beneath the front and rear portions of the arm of the user, and padding means carried on at least the upper portions of said block-like member, the upper surface of said center portion being recessed over substantially the entire extent thereof to define an area of maximum cushioning in the proximity of the middle of the arm pit and the extension absorbing the major portion of the force of the body weight applies to the implement in use.

* * * * *

UNITED STATES PATENT AND TRADEMARK OFFICE

CERTIFICATE OF CORRECTION

PATENT NO. : 4,565,409

DATED : May 5, 1986

INVENTOR(S) : Gary G. Hollonbeck and Hugh E. Cooper

It is certified that error appears in the above—identified patent and that said Letters Patent is hereby corrected as shown below:

Column 3, line 51, delete number "35", insert number --36--.

Signed and Sealed this

*Eighth* Day of *July 1986*

[SEAL]

*Attest:*

DONALD J. QUIGG

*Attesting Officer*

*Commissioner of Patents and Trademarks*